US008171765B2

(12) United States Patent
Rusch

(10) Patent No.: US 8,171,765 B2
(45) Date of Patent: May 8, 2012

(54) TUBE BENDING MACHINE

(76) Inventor: Christopher J. Rusch, Two Rivers, WI (US)

( * ) Notice: Subject to any disclaimer, the term of this patent is extended or adjusted under 35 U.S.C. 154(b) by 162 days.

(21) Appl. No.: 12/660,939

(22) Filed: Mar. 8, 2010

(65) Prior Publication Data

US 2011/0100084 A1 May 5, 2011

Related U.S. Application Data

(60) Provisional application No. 61/280,565, filed on Nov. 5, 2009.

(51) Int. Cl.
*B21D 7/04* (2006.01)

(52) U.S. Cl. ..... 72/149; 72/157; 72/158; 72/217; 72/321

(58) Field of Classification Search ..... 72/149, 72/157, 158, 217, 218, 219, 307, 319, 320, 72/321, 383, 459
See application file for complete search history.

(56) References Cited

U.S. PATENT DOCUMENTS 2,839,957 A * 6/1958 Buckwalter et al. ..... 72/449
3,785,190 A * 1/1974 Schall et al. ..... 72/149
4,428,216 A * 1/1984 Fling ..... 72/156
4,843,858 A * 7/1989 Grimm et al. ..... 72/149
6,644,079 B2 * 11/2003 Harman et al. ..... 72/15.4
7,743,636 B2 * 6/2010 Rusch ..... 72/149
7,900,495 B2 * 3/2011 Latoria ..... 72/458

OTHER PUBLICATIONS

Website printout for JD Squared, Inc.'s "Model 3" tube and pip bender sold since prior to 2008.
Website printout for JMR Tubing Bender at Sant Enterprises, Inc.'s "Model 1000" electric/hydraulic tube and pipe bender sold since prior to 2008.
Website printout for Pro-Tools, Inc.'s, "Pro Model 105" mechanical tube and pipe bender sold since prior to 2008.

* cited by examiner

*Primary Examiner* — David Jones
(74) *Attorney, Agent, or Firm* — Jeffrey S. Sokol

(57) ABSTRACT

This invention is a manually operated tube bending machine with a power drive mechanism that is adjustably set to a desired bend speed. The bending machine includes a bending die, a counter die and a rotating hook die to form a desired bend into a tube or pipe. The tube bender includes a drive wheel with ratchet teeth around its perimeter. A drive pin grips one of the ratchet teeth. The drive pin is secured to a lever and torque bar. During each bending stroke, the lever and torque bar incrementally rotate the drive wheel a desired amount. The rotation of the drive wheel and hook die draw the tube through the bending and counter dies to bend the tube. An anti-spring back mechanism holds the position of the drive wheel while the power drive mechanism is advanced to grip the next ratchet tooth of the drive wheel.

18 Claims, 10 Drawing Sheets

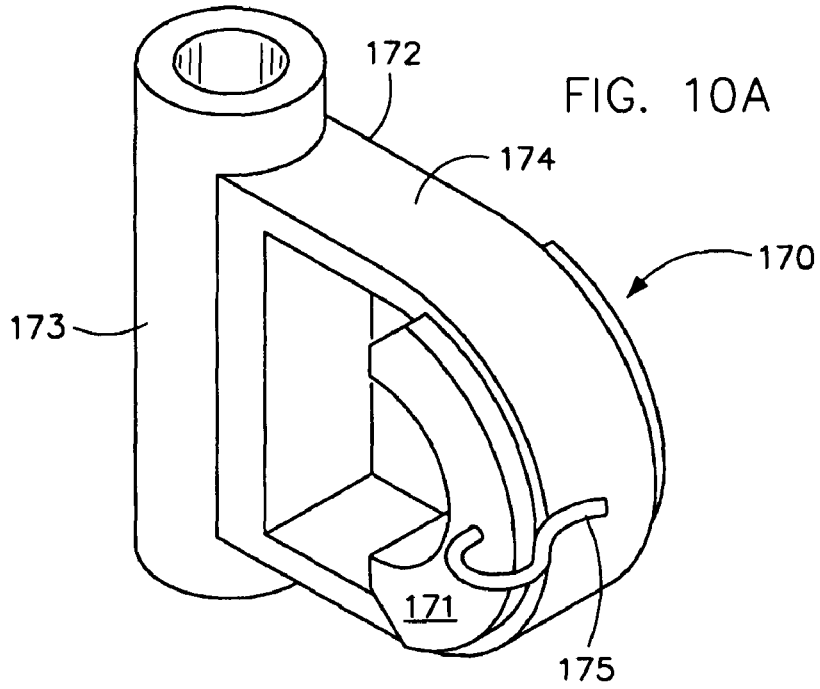
FIG. 10A
FIG. 10B
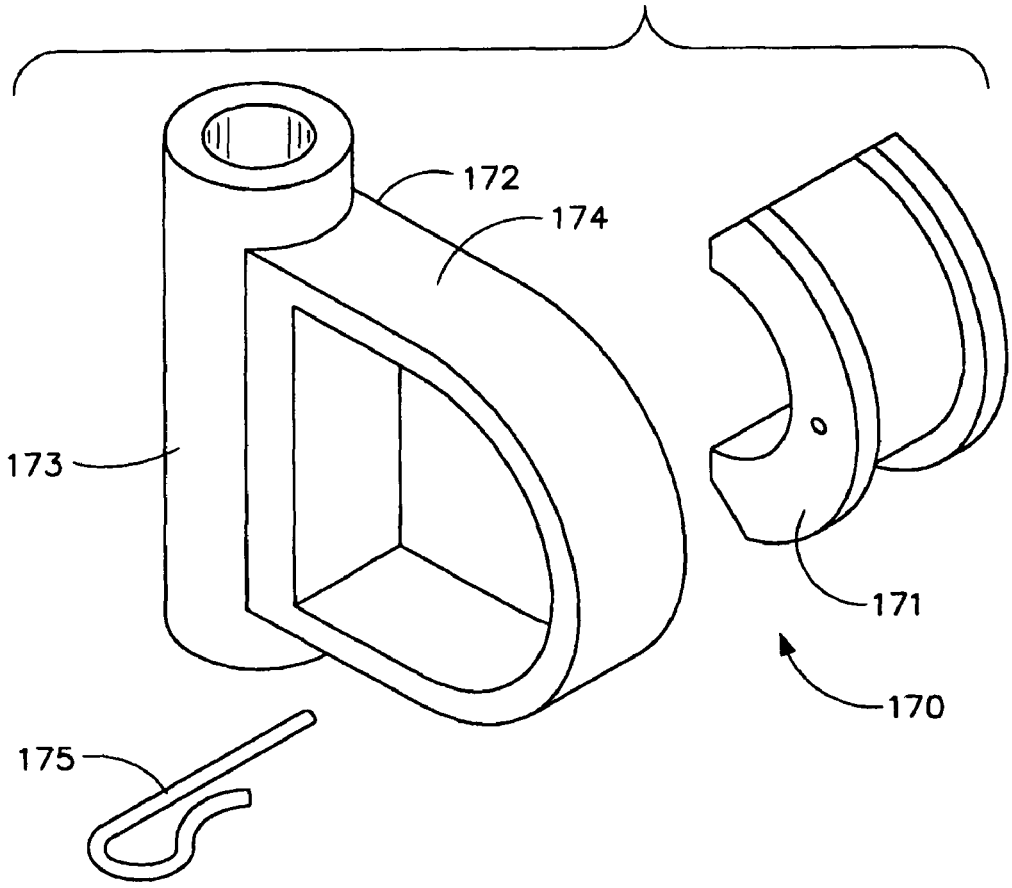

TUBE BENDING MACHINE

This application asserts priority on U.S. Provisional Application No. 61/280,565 filed Nov. 5, 2009.

TECHNICAL FIELD OF THE INVENTION

This invention relates to a manually operated tube bending machine with a variable speed drive.

BACKGROUND OF THE INVENTION

Manually operated tube benders rely on human power and leverage to bend a workpiece such as a tube, pipe or rod. The manual tube bender is typically secured to the floor or another fixed structure. In the 1930s, a manual bender was developed that fixed the workpiece to the bender, and used a long lever to bend the workpiece. The problem with this design is that the larger or more rigid the workpiece, the long lever need to be and the more unobstructed floor space was needed to operate the device. In the 1980s, a manual tube bender was introduced that included a linear ratchet device to multiply the force of the lever. The problem with this design is that the linear ratchet had a length of about 18 inches, and could only produce a continuous bend of about 30°. Then, the workpiece had to be removed and realigned on the bender. In many instances the bender had to be partially disassembled and reassembled to set the workpiece to continue the bend. When the workpiece was being bent 180°, the operation was quite tedious and time consuming. There was also a safety concern in that the operator had to hold the work piece during the bending operation. In about 2000, the Rusch Model 100 was introduced. This design incorporated a drive wheel in place of the linear ratchet device to allow a continuous 180° bend. However, this design suffered from the same problem of the linear ratchet design, in that the power multiplier only advanced one ratchet tooth at a time. Easily bent workpieces had to be bent at the same rate of speed as larger and more rigid workpieces. This design was also expensive to manufacture.

The present invention is intended to solve these and other problems.

BRIEF DESCRIPTION OF THE INVENTION

This invention pertains to a manually operated tube bending machine with a power drive mechanism that is adjustably set to a desired bend speed. The bending machine includes a bending die, a counter die and a rotating hook die to form a desired bend into a tube or pipe. The tube bender includes a drive wheel with ratchet teeth around its perimeter. A drive pin grips one of the ratchet teeth. The drive pin is secured to a lever and torque bar. During each bending stroke, the lever and torque bar incrementally rotate the drive wheel a desired amount. The rotation of the drive wheel and hook die draw the tube through the bending and counter dies to bend the tube. An anti-spring back mechanism holds the position of the drive wheel while the power drive mechanism is advanced to grip the next ratchet tooth of the drive wheel.

An advantage of the present variable speed manual tube bending machine is its variable power and speed settings. By a simple pull of pin, quick adjustment of a pull bar, and reinsertion of the pin, an operator can double or triple the speed of the machine. This allows the operator to quickly perform bends on a wide variety of workpieces in varying order.

Another advantage of the present variable speed manual tube bending machine is its ability to make continuous 180 bends without stopping to reposition the tool or workpiece.

A further advantage of the present variable speed manual tube bending machine is that the operator does not need to hold or touch an inherently dangerous part of the machine such as the drive wheel or workpiece during operation.

A still further advantage of the present variable speed tube bending machine is its easy of construction and reduced manufacturing cost. For example, the hook die is held by a separate die platform and does not need to be secured or incorporated into the bending die. This feature alone has a significant reduction in manufacturing cost.

A still further advantage of the present variable speed tube bending machine is its hook die assembly which allows the operator to quickly change from one tube size to another, and provides ease of manufacture.

A still further advantage of the present variable speed tube bending machine is that its bend degree indicator or wheel position indicator is located on the drive wheel and its large size and diameter allows for better operator accuracy.

Other aspects and advantages of the invention will become apparent upon making reference to the specification, claims and drawings.

BRIEF DESCRIPTION OF THE DRAWINGS

FIG. 10A is a perspective view of the hook die assembly.

FIG. 10B is an exploded view of the hook die assembly.

DESCRIPTION OF THE PREFERRED EMBODIMENT

Figure 1:
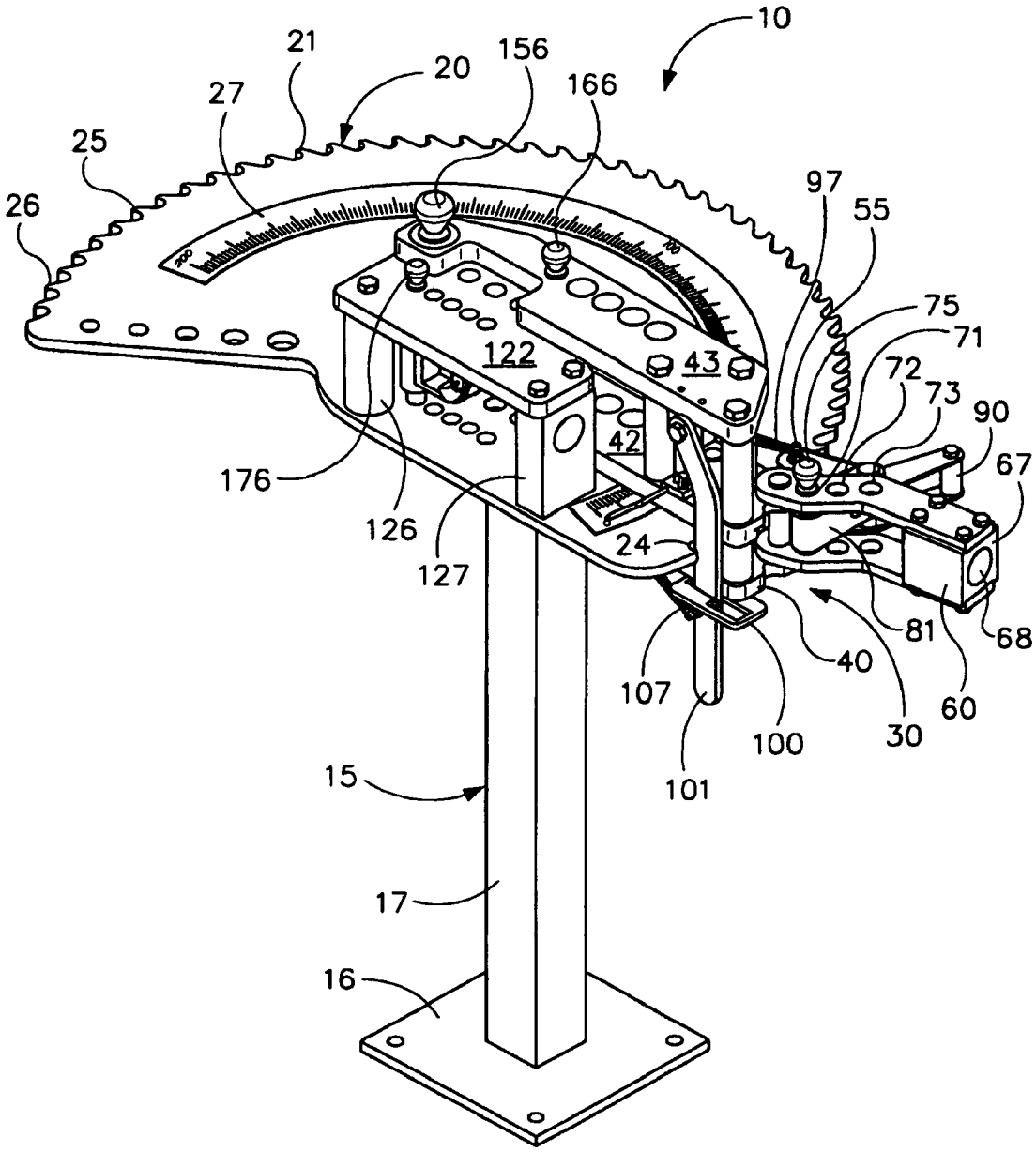
FIG. 1 is a front perspective view of the manual tube bender invention secured to its mounting pedestal, with the power drive mechanism at its home position and set for maximum bending power and the anti-springback lever engaging the first or 0° ratchet of the drive wheel.

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

The present invention generally relates to a manually operated tube bending machine generally shown by reference number 10. The tube bending machine 10 is mounted on a stationary pedestal 15. The pedestal includes an anchor plate 16 that is firmly secured by bolts or otherwise to the floor of a building, or some other fixed structure. An integral riser 17 extends upwardly from the anchor plate 16. The riser 17 supports a stationary upper mounting plate 18. The mounting plate 18 forms a generally horizontal surface for mounting the working components of the tube bending machine 10 at a convenient location above the floor of the building.

The manual tube bender 10 includes a disc shaped drive wheel 20 with flat upper and lower surfaces. The disc shaped wheel 20 is slightly more than a semi-circle and forms a circular arc of about 200° along its perimeter. The drive wheel 20 includes a number of uniformly spaced ratcheted teeth 21 around its circular perimeter. Although the radius of the drive wheel 20 and number of the teeth 21 can vary, the wheel preferably has a radius of about 2 feet with each tooth having a radial length of about 4°. The teeth 21 have a conventional ratchet shape. Each tooth 21 defines a forward tube slot 22 and includes a forward sloping ramp 23. The first tooth slot 24 defines the home position for the drive wheel 20. On the opposite side of the drive wheel 20 is a tooth 25 that is 180° from the home position 24. Extra teeth 26 extend forward from the opposite tooth 25 for reasons discussed below. The drive wheel 20 includes an angular scale 27 on its upper surface. The scale 27 is marked with angular degrees from 0° to 180°. Five lineally aligned hook die holes 28 are formed in the drive wheel 20. These die holes 28 are generally in line with the home position 24. The circular perimeter of the drive wheel 20 defines a central axis of rotation 29 for the wheel and other working components of the tube bending machine 10.

A power drive assembly 30 for supporting and incrementally rotating the drive wheel 20 is secured to the upper plate 18 of the stationary pedestal 15. The power drive assembly 30 includes a stationary base frame assembly or drive platform 40. The drive platform 40 includes a lower base plates 41, an upper base plate 42 and a counter-die platform 43. The plates 41 and 42 and platform 43 are in spaced parallel registry and remain stationary during the operation of the tube bender 10. The plates 41, 42 and platform 43 are rigidly joined to each other, and the lower plate 41 is rigidly joined to the upper plate 18 of the stationary pedestal 15. Five linearly aligned counter die holes 44 are formed in the upper base bar 42 and counter-die platform 43. The base plates or bars 41 and 42 and platform 43 are joined by a central joint or bolt assembly 45 aligned on axis 29, and extend outwardly toward and preferably to a location beyond the outer perimeter of the drive wheel 20. The central bolt assembly 45 includes a sleeve and an inner bolt. Two forward bolts 48 rigidly join the counter-die platform 43 to the upper base plate 42. A third outermost bolt 49 rigidly joins the lower and upper base bars 41 and 42 and the counter-die platform 43.

The power drive assembly 30 includes a rocker arm or pivot assembly 50, with lower and upper selectively pivotable rocker bars 51 and 52. The rocker bars 51 and 52 are in spaced parallel registry and are rigidly joined to move in unison. The rocker bars 51 and 52 nest between the stationary base bars 41 and 42 and straddle and snuggly receive the drive wheel 20. The rocker bars 51 and 52 are pivotably secured to the central bolt assembly 45, and extend outwardly toward and preferably to a location beyond the outer perimeter of the drive wheel 20. The outer end of the rocker bars 51 and 52 hold a driver 55 that preferably takes the form of a drive pin. A number of bearings 57 and 58 are embedded in or fixed to the rocker bars 51 and 52 to minimize friction with the base bars 41 and 42 and drive wheel 20 during operation.

A power drive assembly 60 is secured to the outer ends of the base bars 41 and 42 and the pivot bars 51 and 52. The assembly 60 includes a lever 61 with upper and lower bars 62. The lever bars 62 are in spaced registered parallel alignment, and include an inner arcuate portion 63 and an outer axial portion 64. The inner end of the lever 60 is secured to the outer ends of the base bars 41 and 42 by a fulcrum 65 that is preferably in the form of a bolt. The fulcrum bolt 65 forms an axis of rotation 66 for the reciprocating pivoting motion of the lever 61. The outer ends of the lever bars 62 are secured to a torque block 67 by a number of bolts. The torque block 67 includes an outwardly facing hole 68 for receiving a torque bar 69. When inserted into the mounting hole 68, the lever 61 and its torque bar 69 move as a single rigid component. The arcuate portion 63 of the power drive lever 61 includes three uniformly spaced positions 71, 72 and 73 that preferably take the form of holes that extend generally axially from the fulcrum bolt 65. A lever 61 is set to one of these positions 71, 72 or 73 by inserting a lever pin 75 into one of these holes. The power drive lever assembly 60 also includes a pull bar 81 and a driven pin 85. The driven pin 85 is secured to the outermost ends of the pivot bars 51 and 52. Again, it should be understood that the driven pin 85 can take other forms such as a bolt, cog or the like to provide a pivotable connection.

The lever pin 75 sets the power or speed level of the tube bender 10. The distance between the fulcrum bolt 65 and drive pin 75 determines the amount of incremental movement of the drive wheel 20 and drive pin 55 during each stroke cycle 87 of the torque bar 69. When the drive pin 75 is inserted in the first or inner most hole for maximum power and minimum speed, the power drive assembly 30 rotates the drive wheel 20 through an arc length equal to one ratchet tooth 21 (about 4°) during each power stroke 88 of the torque bar 69. Similarly, the drive pin 55 advances one ratchet tooth 21 (about 4°) during each return stroke 89 of the torque bar 69. When the drive pin 75 is inserted into the second or middle hole for medium power and medium speed, the power drive assembly 30 rotates the drive wheel 20 through an arc length equal to two ratchet teeth 21 (about 8°) during each power stroke 88 of the torque bar 69, and the drive pin 55 advances two ratchet teeth during each return stroke 89 of the torque bar. Each stroke 88 of the power drive 30 bends the tube 5 twice as much, which increases the speed of the machine 10 but reduces bending power. When the drive pin 75 is inserted in the third or outermost hole 73 for minimum power and maximum speed, the power drive assembly 30 rotates the drive wheel 20 through an arc length equal to three ratchet teeth 21 (about 12°) during each power stroke 88 of the torque bar 69, and the drive pin 55 advances a similar three tooth amount forward during each return stroke 89. Each stroke 88 of the power drive 30 bends the tube 5 three times that of when the pin 75 is in the first or inner hole 71. Although the power drive assembly 60 is shown with three settings or lever 61 positions 71, 72 or 73, it should be understood that the assembly could include two settings or more than three settings without departing from the broad aspects of the present invention.

The power drive assembly 30 includes an engagement mechanism 90 for engaging and disengaging the power drive. A pair of engagement plates 91 is movingly secured to the outer ends of the pivot bars 51 and 52. The upper engagement plate 91 lays flat against the upper surface of the upper pivot bar 52. Each plate 91 has a double slotted hole 92 formed by a shorter disengagement slot 93 that merges with a longer engagement slot 94. A handle 95 is secured to one end of the plates 91. The inner end of the plates 91 firmly holds the ratchet drive pin 55. A spring biasing mechanism 97 biases the plates 91 and the drive pin 55 into abutting engagement with the ratchet teeth 21. The spring 97 biases the drive pin 55 to move into one of the slots 22 between the teeth 21. During the advancement stroke 89 of the torque bar 68, the biasing mechanism 97 permits the drive pin 55 to ride up along the ramped surface 23 of the tooth until it drops down into the next tooth slot 22. When the driven pin 85 is nested in the longer slot 94, the power drive assembly 30 is in its engaged position 98. When the driven pin 85 is in the shorter slot 93, the power drive assembly 30 is in its disengaged position 99.

The power drive assembly 30 also includes an anti-springback mechanism 100. This mechanism 100 holds the drive wheel 20 radially fixed during the return stroke 89 of the lever 60 and torque arm 69, and releases the load on the ratchet drive pin 55 so that the pin can move to the next tooth slot 22 as discussed above. The anti-springback mechanism 100 includes a lever 101 with an angled portion and a vertical portion. The upper end of the lever 101 is pivotably mounted at a fixed position 102 near the outer end of the counter-die platform 43 of the stationary base frame 40. The lower or opposite end of the lever 101 is free to pivot about the fixed mount 102 and is movingly held by a lower rocker mount 103 rigidly secured to lower base plate 41 of the base frame 40. The rocker mount 103 includes a double slotted hole 104 formed by a longer engagement slot 105 that merges with a shorter disengagement slot 106. The rocker mount 103 is positioned below and is axially aligned with the perimeter of the drive wheel 20. The longer slot 105 has an inner portion in vertical registry with the slots 22 of the drive wheel teeth 21. The outer portion of the slot 105 extends outwardly beyond the drive wheel teeth 21. The shorter slot 106 does not include an inner portion and only extends outwardly beyond the drive wheel teeth 21. A spring 107 biases the lever 101 axially inward toward the drive wheel teeth 21. When the lever 101 nests in the longer slot 105, the anti-springback mechanism 100 is in its engaged position 108. The anti-springback mechanism 100 is moved to its disengaged position 109 by moving the lever 101 into the shorter slot 106. In the disengaged position 109, the lever 101 is held outwardly from and does not come in contact with the drive wheel teeth 21.

Figure 2:
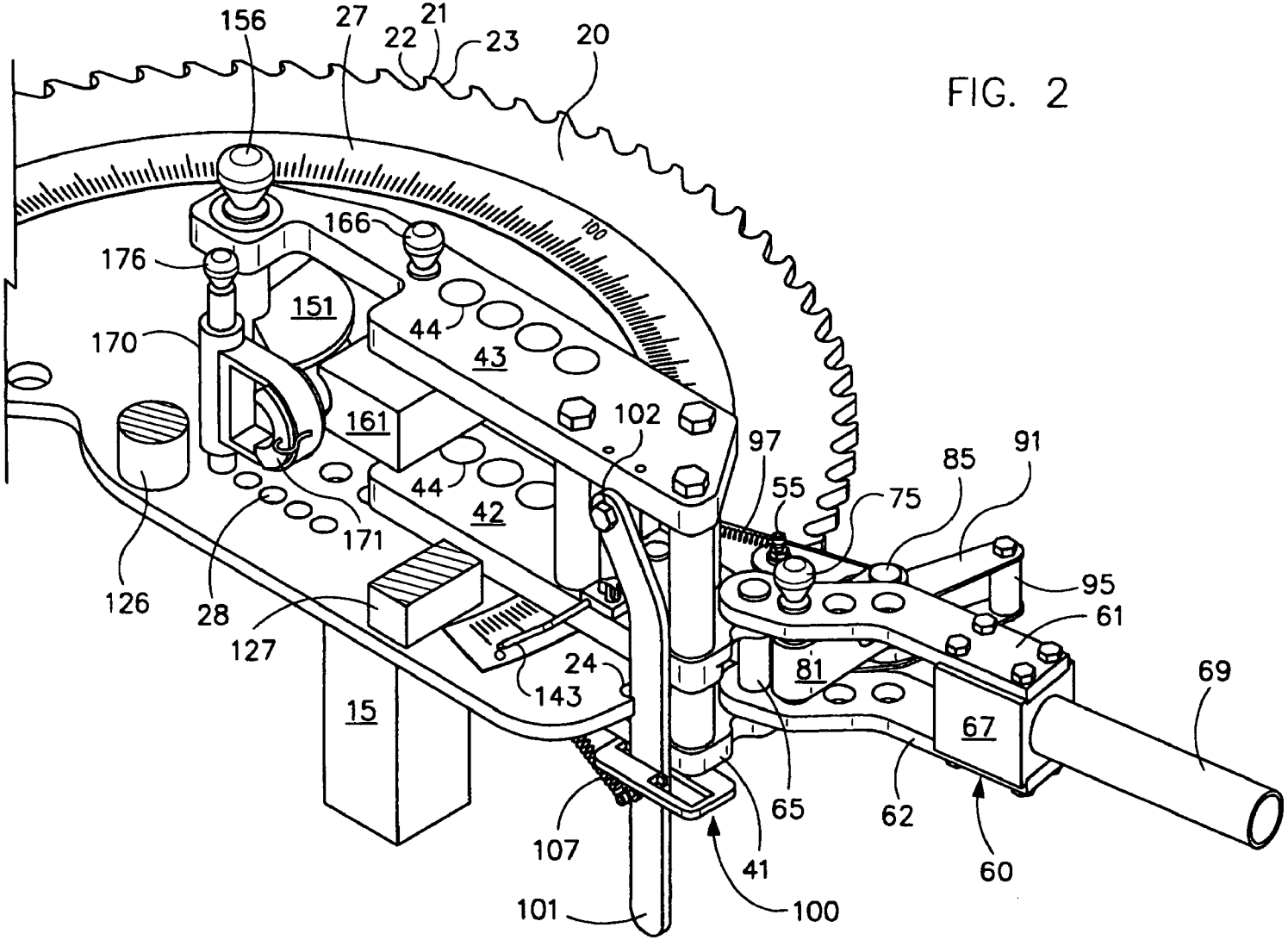
FIG. 2 is a perspective view of the tube bender at its home position, with the hook die platform cut away to show the alignment of the bending, hook and counter dies.

A hook die platform 120 is rigidly secured to the top of the drive wheel 20. The platform 120 includes a hook die plate 122 with five linearly aligned holes 124 that are in linear registry with the five holes 28 of the drive wheel 20. The hook die plate 122 is spaced from the drive wheel 20 by inner and outer mounting posts 126 and 127. The outer mounting posts 127 include a hole for receiving the torque bar 69. When the torque bar 69 is inserted into hole 128, the power drive assembly 30 is disengaged 99 and the anti-springback mechanism 100 is disengaged 109, then the operator can manually rotate the drive wheel to bend a tube or pipe 5 without the use of the power drive assembly 30. A pointer assembly 141 is secured to the upper base bar 42 by a mounting bracket. A pointer 143 extends from the mounting bracket toward the angular scale 27. When the bending machine 20 is in its home position with the anti-springback lever 101 engaging the first tooth 24, the tip of the pointer points at 0° as shown in FIGS. 1-3.

The bending machine includes die assemblies 150, 160 and 170. The bending die assembly 150 is formed by a bending die 151, a mounting sleeve 153 and a mounting pin 156. The center of the bending die 151, sleeve 153 and pin 156 are centrally aligned with the axis of rotation 29 of the bending machine 10. The bending die 151 rotates with the drive wheel 20. The counter die assembly 160 is secured between the counter die platform 43 and the upper base bar 42 via counter die holes 44. The counter die assembly 160 includes a counter die 161, a mounting sleeve 163 and a mounting pin 166. The hook die assembly 170 is secured between the hook die platform 121 and the drive wheel 20 via holes 28 and 124. The hook die assembly 170 includes a removable hook die 171 and a hook die mount 172. The hook die mount 172 has a mounting sleeve 173 and a strap 174. The removable hook die 171 is secured to the strap 174 by a clip 175. The bending die 151, counter die 161 and hook die 171 form a matched set to bend a tube 5 having a specific diameter into a bend with a desired bend radius. The dies 151, 161 and 171 are readily changed so the tube bending machine 10 can bend a variety of tube diameters into a variety of bend radii.

Figure 3:
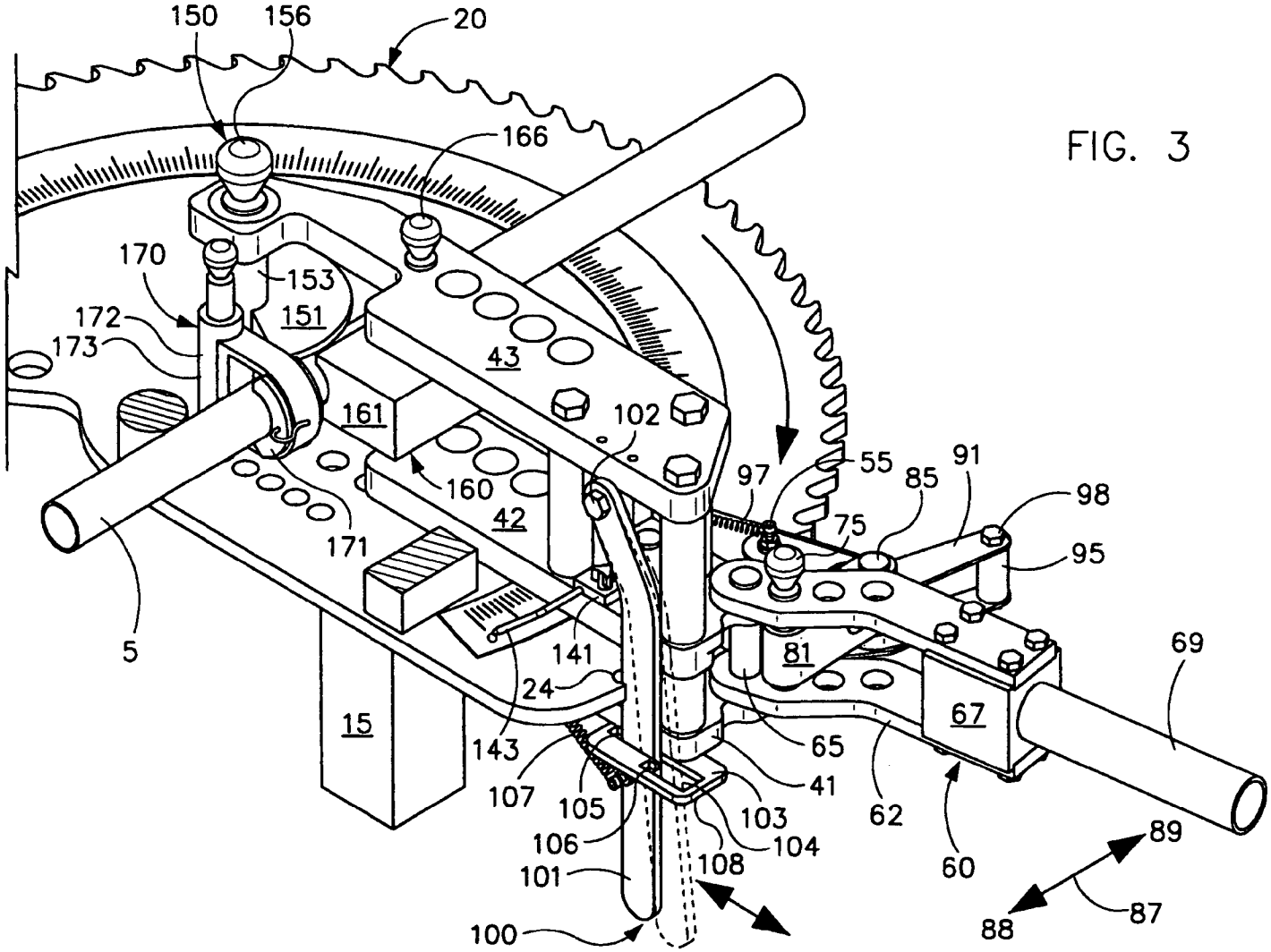
FIG. 3 is a perspective view of the tube bender at its home position, with the hook die platform cut away to show the dies receiving a straight tube prior to bending.
Figure 4:
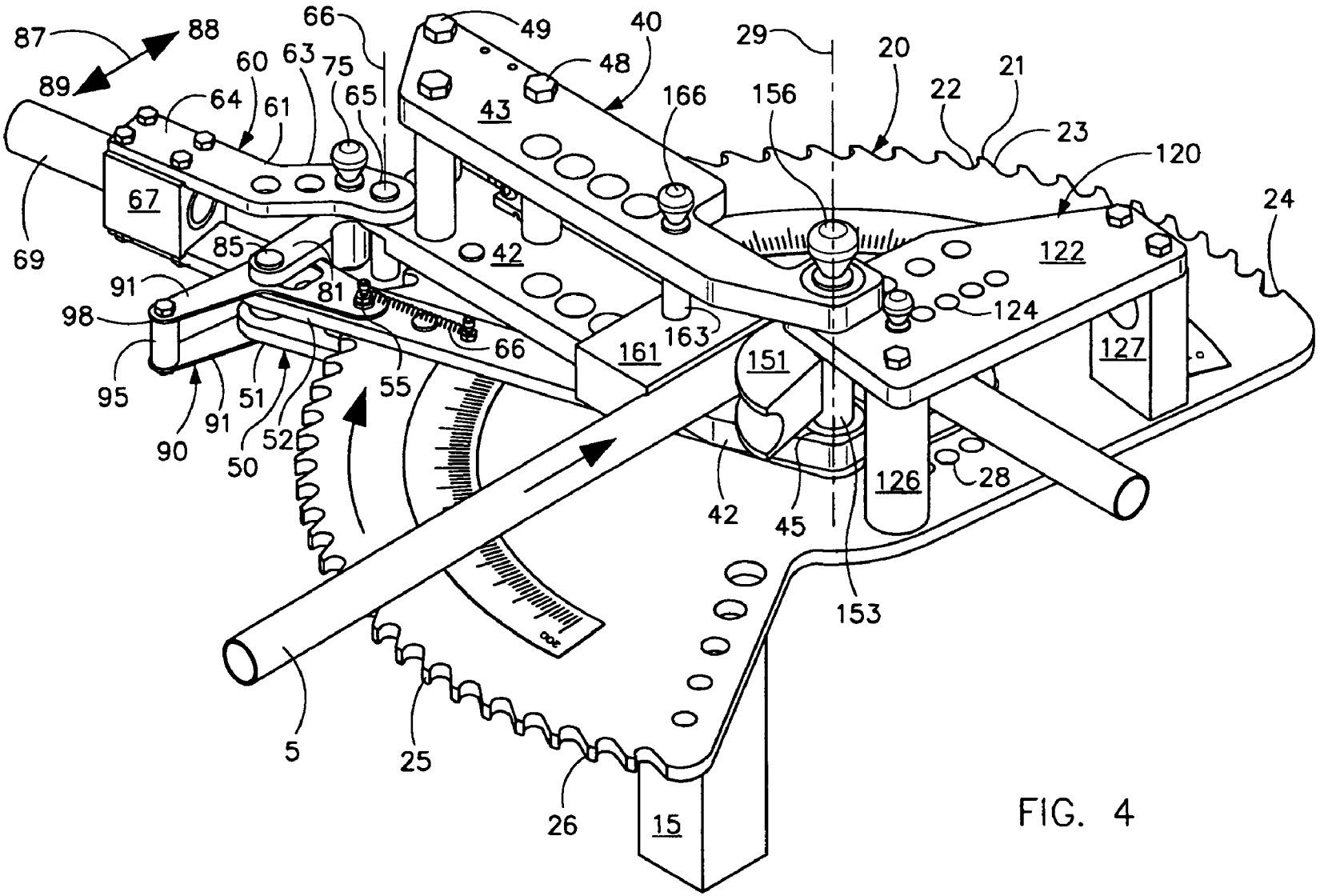
FIG. 4 is a perspective view of the manual tube bender after the drive wheel has been advanced 90° by the drive mechanism to bend the tube to a 90° angle.
Figure 5:
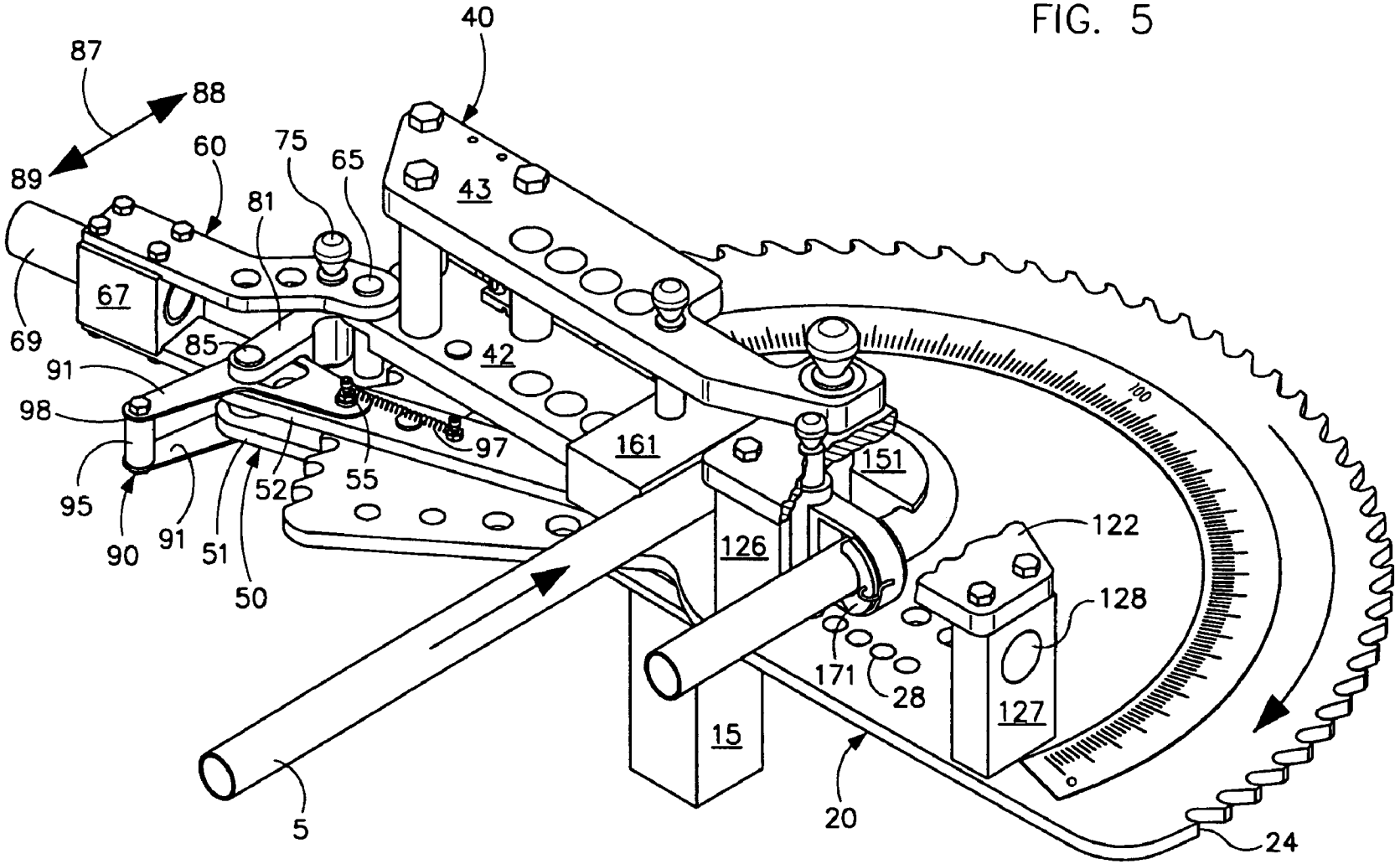
FIG. 5 is a perspective view of the manual tube bender after the drive wheel has been advanced 180° by the drive mechanism, and with the hook die platform cut away to show the tube bent to a full 180° angle.
Figure 6:
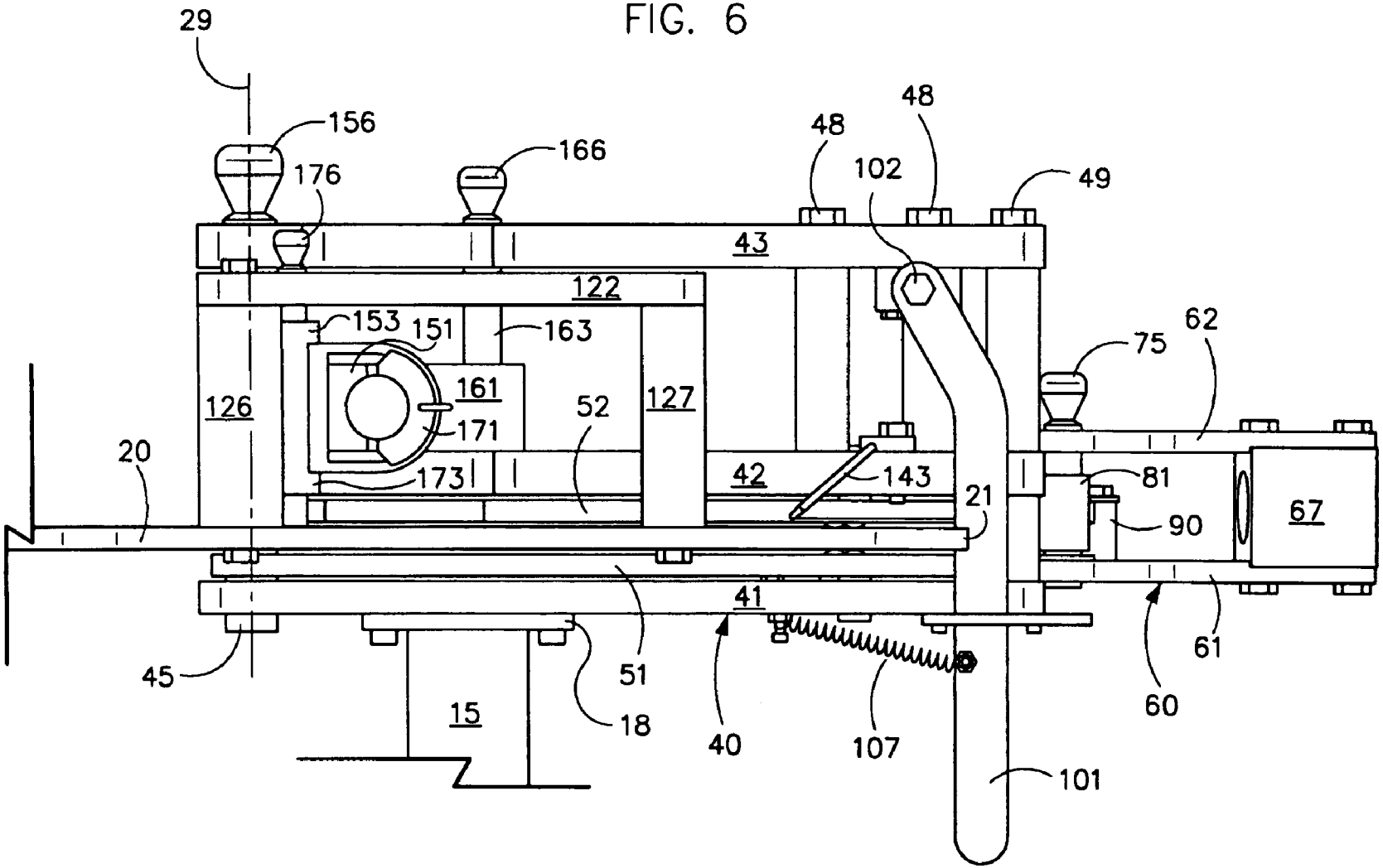
FIG. 6 is a side elevation view showing the framework for the drive mechanism, drive wheel and anti-springback lever, and the common central axis of rotation for the drive wheel and bending die.
Figure 7:
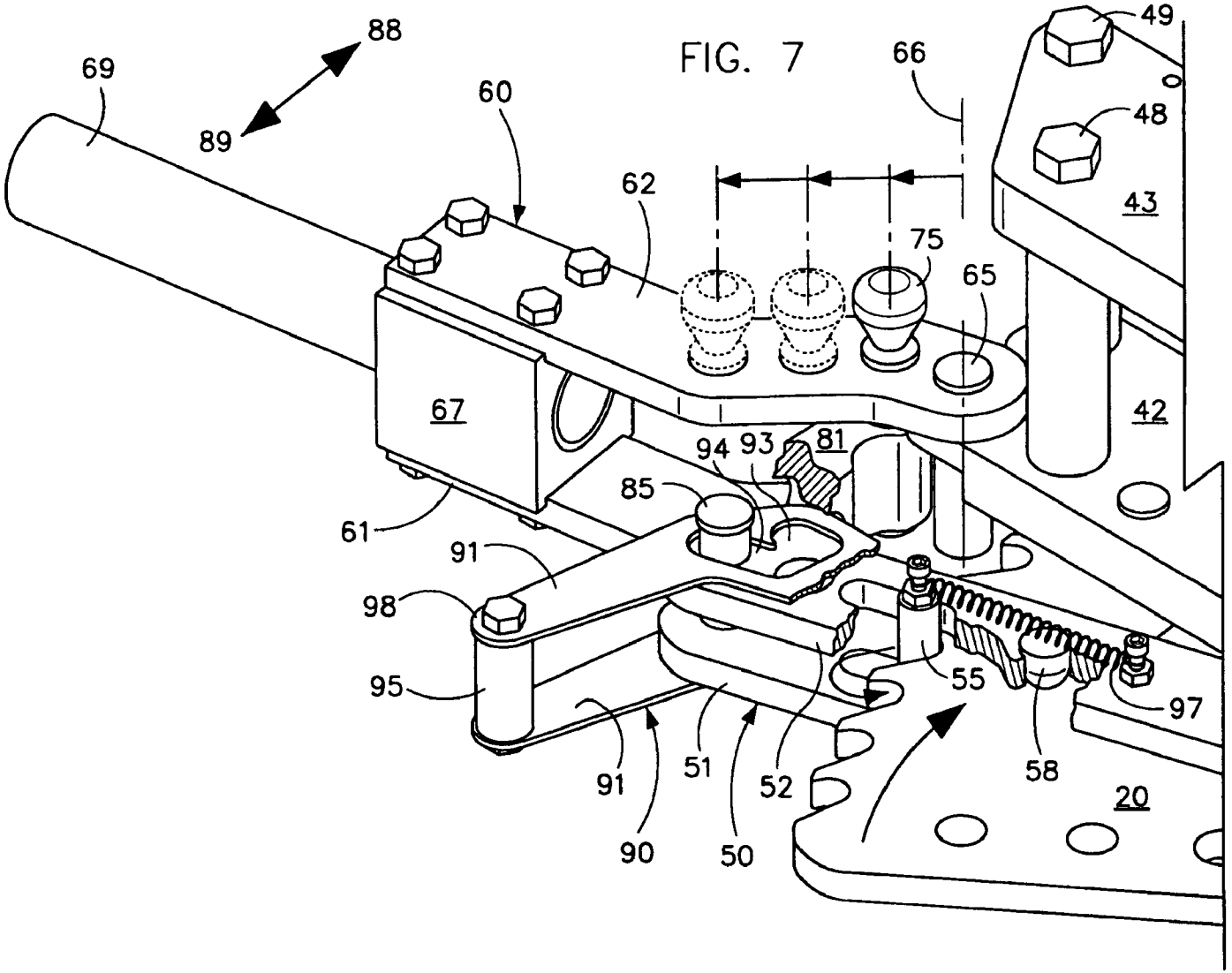
FIG. 7 is an enlarged perspective view of the bend drive mechanism in its engaged position with the upper pivot bar and power drive engagement plate cut away to show the ratchet drive pin engaged in a ratchet of the drive wheel, and with the lever drive pin set for maximum power, and arrows showing the directions of the simultaneous movement of the drive handle and drive wheel during a bending stroke.
Figure 8:
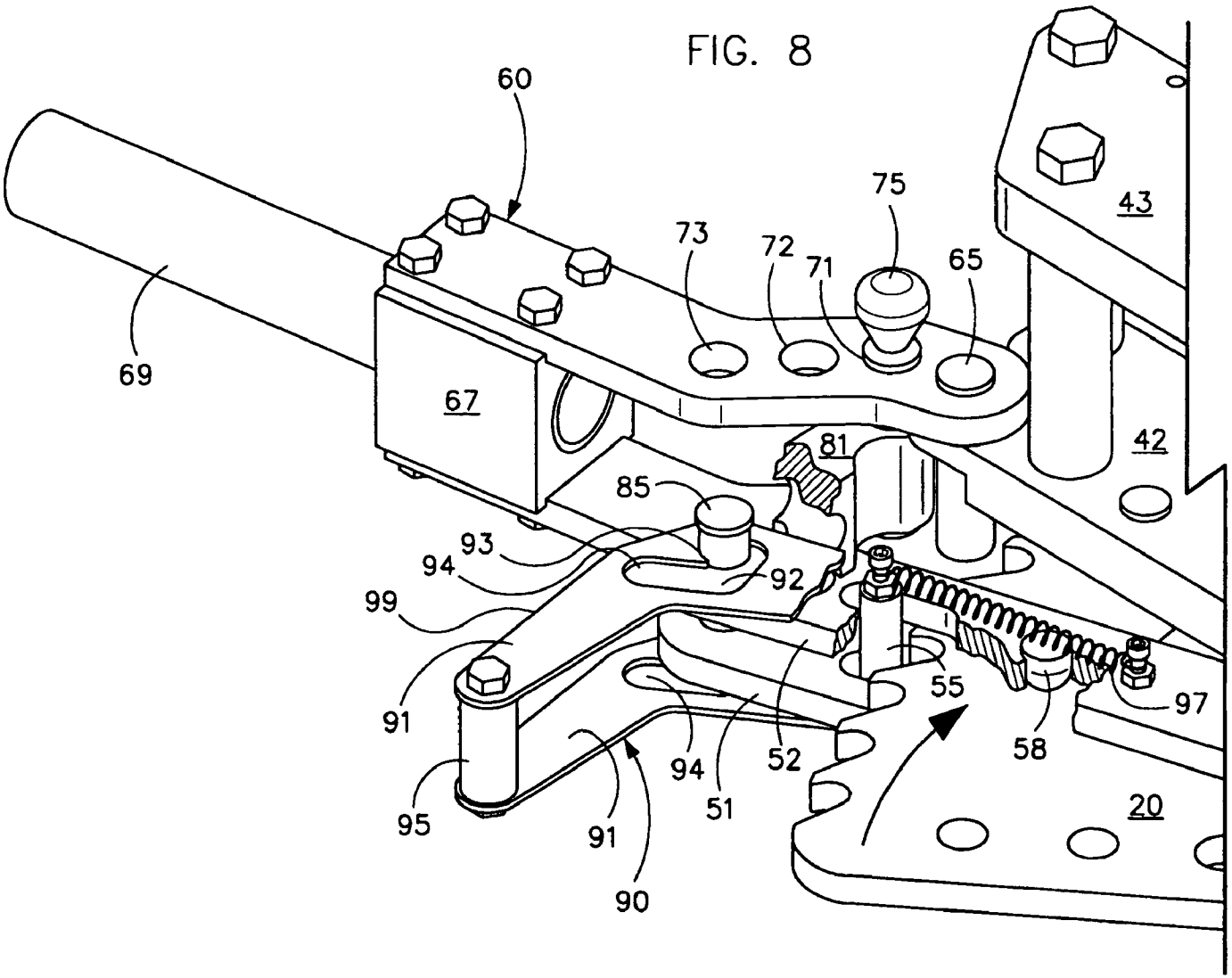
FIG. 8 is an enlarged perspective view showing the bend drive mechanism disengaged by pulling back the power drive engagement plate (partially cut away) to hold the drive pin out of engagement with the ratchets of the drive wheel.

During power drive operation of the tube bending machine 10 as in FIGS. 3-5, the torque bar 69 is secured to the lever 60. The power drive engagement and anti-springback mechanisms 90 and 100 are set to their engaged positions 98 and 108. Springs 97 and 107 bias the drive pin 55 and lever 101 into nested engagement with the slots 22 of corresponding drive wheel teeth 21. During each power stroke 88 of the torque bar 69 to bend the tube 5, the shape of the tooth slot 22 maintain the ratchet drive pin 55 in locked load bearing engagement with its tooth 21. The movement of the lever 60 and torque arm 69 force the ratchet pin 55 and the engaged tooth 21 radially toward the outer end of the base frame 40 to rotate the drive wheel an incremental distance set by the lever pin 75. During each power or bending stroke 88, the lever 101 rides up the ramp 23 of a corresponding tooth 21. Just prior to the end of the power stroke 88, the lever 101 moves inwardly or drops into the tooth slot 22 of that next corresponding tooth 21. During the power stroke 88, the bending load is carried by the base and rocker frames 40 and 50, lever 60, pull bar 81 and pins 55, 65, 75 and 85, as well as the drive wheel 20 and hook die platform 120.

During each return stroke 89 of the torque arm 69, the lever 101 remains in its tooth slot 22, and is forcibly pressed against the side of the slot 22 of the tooth 21. This pressing force is generated by the springback load of the bent tube 5. The springback load is carried by the drive wheel 20, base frame 40, anti-springback mechanism 100 and hook die platform 120. During the return stroke 89, the drive pin 55 moves axially outward as the pin 55 slides along the ramped surface 23 of the next adjacent tooth 21. When the pin 55 passes the apex of that next tooth, the pin is pulled axially inward by the spring 97 to nest in the slot 22 of that next adjacent tooth to complete one full stroke cycle 87 of the power drive assembly 30. During the return stroke 89, bending load on the rocker frame 50, lever 60, pull bar 81 and pins 55, 65, 75 and 85 is released by the engagement of the anti-springback mechanism 100.

Figure 9:
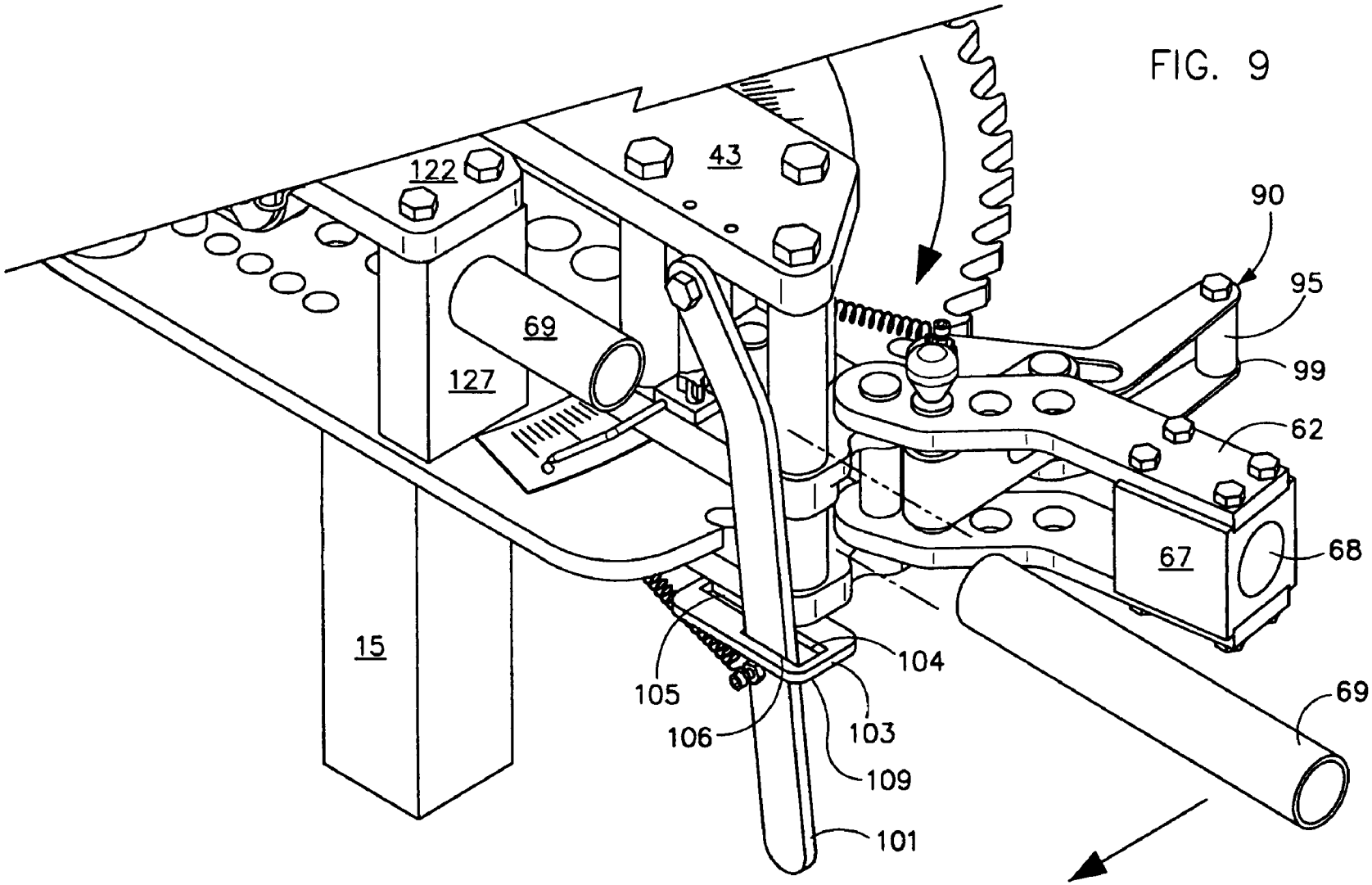
FIG. 9 is an enlarged view of the anti-springback lever disengaged (hard lines) and the torque bar fixed directly to the hook die platform.

The tube bending machine 10 can be used without the aid of the power drive lever 60 as shown in FIG. 9. The power drive engaging mechanism 90 is placed in its disengaged position 99 so that the ratchet drive pin 55 does not engage the drive wheel teeth 21. Similarly, the anti-springback mechanism 100 is placed in its disengaged position 109 so that the lever 101 does not engage the drive wheel teeth 21. The torque bar 69 is then removed from the lever 60 and inserted into the hole 128 of the hook die platform. The operator then rotates the torque bar 69 around stationary pedestal 15. The drive wheel 20, hook die platform 120, hook die 171 and bending die 151 rotate with the torque bar 69 to pull the tube 5 passed the counter die 161 and around the bend die 151. The base frame 40, counter die platform 43 and counter-die 161 remain stationary, as do the rocker frame 50 and lever drive 60 which are not in use.

While the invention has been described with reference to a preferred embodiment, it will be understood by those skilled in the art that various changes may be made and equivalents may be substituted without departing from the broader aspects of the invention.

I claim:

1. A manually operated tube bender for bending a workpiece such as a tube, pipe or rod, said manually operated tube bender comprising:

a drive wheel with a generally circular shaped perimeter to define a central axis, said perimeter having a plurality of uniformly spaced ratchet teeth, each of said ratchet teeth having a predetermined length;

a drive platform rotatably joined to said drive wheel by a central joint assembly aligned with said central axis of said drive wheel; said drive platform extending toward said perimeter of said drive wheel, and said tube bender including a bending die, a counter die and a hook die adapted to securely receive and grip the workpiece;

a rocker arm pivotally joined to one of either said central joint assembly and said drive platform, said rocker arm extending toward said perimeter of said drive wheel and carrying a driver biased into engagement with one of said ratchet teeth of said drive wheel;

a power drive assembly including a lever and a pull bar, said lever having a first section pivotally joined to said drive platform by a fulcrum, a second section that receives an elongated torque bar, and a midsection with at least first and second power control positions, said pull bar being set to one of either said first and second power control positions, said pull bar extending toward and being secured to said rocker arm, said first power control position being spaced a first incremental distance from said fulcrum, and said second power control position being spaced a second incremental distance from said fulcrum; and wherein said torque bar is stroked back and forth in a cyclical motion through a stroke cycle to bend the workpiece, said torque arm being stroked in one direction during each cycle with said driver in locked engagement with said one ratchet tooth to draw said rocker arm and drive wheel toward said drive platform to bend the workpiece an incremental amount, and said torque arm being stroked in an opposite direction during each cycle to advance said driver to another ratchet tooth, said driver being advanced one ratchet tooth each stroke cycle and the workpiece being bent a first incremental amount corresponding to one ratchet tooth each stroke cycle when said pull bar is set to said first power control position, and said driver being advanced two ratchet teeth each stroke cycle and the workpiece being bent a second larger incremental amount corresponding to two ratchet teeth each stroke cycle when said pull bar is set to said second power control position.

2. The manually operated tube bender of claim 1, and wherein lever includes at least a third power control position spaced a third incremental distance from said fulcrum pin, said third incremental distance corresponding to said length of three of said ratchet teeth, and said driver being advanced three ratchet teeth each stroke cycle when said pull bar is set to said third control position.

3. The manually operated tube bender of claim 2, and wherein setting said pull bar at said first power control position provides maximum bending pdwer, setting said pull bar at said second power control position provides reduced bending power and increased bending speed, and setting said pull bar at said third power control position provides further reduced bending power and further increased bending speed.

4. The manually operated tube bender of claim 1, and further comprising a stationary pedestal, said drive platform being rigidly fixed to said stationary pedestal, and said drive wheel rotating about said stationary pedestal and platform during operation.

5. The manually operated tube bender of claim 4, and wherein said central joint assembly receives a first removable mounting pin to selectively hold said bending die, and said drive platform rigidly holding a second mounting pin to selectively hold said counter die.

6. The manually operated tube bender of claim 5, and further comprising a hook die platform secured to said drive wheel, said hook die platform holding a third removable mounting pin to selectively hold said hook die.

7. The manually operated tube bender of claim 6, and wherein said drive platform and rocker arm each have an outer end that extend beyond said perimeter of said drive wheel.

8. The manually operated tube bender of claim 7, and wherein said drive wheel is a generally flat disc, said drive platform is formed by rigidly joined upper and lower plates and a counter die platform, said upper and lower plates being substantially parallel and straddling said drive wheel, said counter die platform being parallel to and spaced above said upper plate, and said upper plate and counter die platform securing said second mounting pin, and said rocker arm is formed by rigidly joined upper and lower rocker bars that move in unison, said upper and lower rocker bars straddling said drive wheel and being located between said upper and lower plates of said drive platform.

9. The manually operated tube bender of claim 7, and wherein said pull bar is pivotally secured to one of said power control positions by a lever pin, and said pull bar is pivotally secured to said outer end of said rocker arm by a driven pin.

10. The manually operated tube bender of claim 7, and wherein said driver is a drive pin and said drive pin is biased by a spring into engagement with said drive wheel, said spring having first and second ends, said first being secured to said driver and said second end being secured to said rocker arm.

11. The manually operated tube bender of claim 7, and wherein said midsection of said lever has an arcuate shape arcing toward said direction said driver advances during operation.

12. The manually operated tube bender of claim 11, and further comprising a power drive disengagement mechanism for overcoming said biasing spring.

13. The manually operated tube bender of claim 12, and wherein said power drive disengagement mechanism includes a double slotted plate secured to said drive pin and to said outer end of said rocker arm via said driven pin, said double slotted plate including a first elongated slot to selectively receive said driven pin and allow said drive pin to engage said drive wheel, and a second shortened slot to selectively receive said driven pin and prevent said drive pin from engaging said drive wheel.

14. The manually operated tube bender of claim 1, and further comprising an anti-springback mechanism having a lever fixed to said drive platform and movable between tooth engaging and tooth disengaging positions, said lever being biased into engagement with said drive wheel teeth when in said tooth engaging position, and said lever being held out of engagement with said drive wheel when in said tooth disengaging position.

15. The manually operated tube bender of claim 14, and wherein said lever locks against one of said ratchet teeth when said torque arm is being stroked to advance said driver to another ratchet tooth and said lever when in said tooth engaging position, and wherein said lever slides up and into locked engagement with a next tooth when said torque arm is being stroked to bend the workpiece and said lever is in said tooth engaging position.

16. The manually operated tube bender of claim 1, and wherein said generally circular shaped perimeter of said drive wheel has a substantially hemispherical shape to allow for 180° bends in the workpiece.

17. The manually operated tube bender of claim 16, and wherein said substantially hemispherical shape of said perimeter of said drive wheel forms a circular arc of about 200°.

18. The manually operated tube bender of claim 1, and wherein said second section of said lever of said power drive assembly removably receives said torque bar.

* * * * *